US007545315B2

(12) United States Patent
Maquet et al.

(10) Patent No.: US 7,545,315 B2
(45) Date of Patent: Jun. 9, 2009

(54) SATELLITE WITH MULTI-ZONE COVERAGE OBTAINED BY BEAM DEVIATION

(75) Inventors: Freddy Maquet, Goyrans (FR); Olivier Maillet, Gugnaux (FR)

(73) Assignee: Thales, Neuilly sur Seine (FR)

( * ) Notice: Subject to any disclaimer, the term of this patent is extended or adjusted under 35 U.S.C. 154(b) by 112 days.

(21) Appl. No.: 10/554,953

(22) PCT Filed: Apr. 29, 2004

(86) PCT No.: PCT/FR2004/001043

§ 371 (c)(1),
(2), (4) Date: Dec. 19, 2005

(87) PCT Pub. No.: WO2004/100306

PCT Pub. Date: Nov. 18, 2004

(65) Prior Publication Data

US 2006/0119504 A1 Jun. 8, 2006

(30) Foreign Application Priority Data

Apr. 30, 2003 (FR) ..... 03 05300

(51) Int. Cl.
*H04B 7/185* (2006.01)

(52) U.S. Cl. ..... 342/354

(58) Field of Classification Search ..... 342/351–377
See application file for complete search history.

(56) References Cited

U.S. PATENT DOCUMENTS 3,267,472 A * 8/1966 Fink ..... 342/368
3,750,175 A * 7/1973 Lockerd et al. ..... 342/371
3,806,932 A 4/1974 Dietrich et al.
4,283,795 A * 8/1981 Steinberger ..... 455/283
4,847,574 A 7/1989 Gauthier et al.
5,848,060 A * 12/1998 Dent ..... 370/281
6,307,507 B1 10/2001 Gross et al.

FOREIGN PATENT DOCUMENTS

EP 0 141 281 A 5/1985
EP 0 674 355 A 9/1995
EP 0 683 543 A 11/1995
EP 1 191 628 A 3/2002

OTHER PUBLICATIONS

B. Rama Roa et al, "SHF Casegrain antenna with electronic beam squint tracking for high data rate mobile satellite communications systems", Digest of the Antennas and Propagation Society International Symposium. Seattle, Washington, Jun. 19-24, 1994, NY, IEEE vol. 3, Jun. 20, 1994, pp. 1028-1031, XP010142314.

* cited by examiner

*Primary Examiner*—Thomas H Tarcza
*Assistant Examiner*—Nga X Nguyen
(74) *Attorney, Agent, or Firm*—Sughrue Mion, PLLC

(57) ABSTRACT

A telecommunication satellite with multi-zone coverage, including at least one transmission and/or reception antenna with at least one transmission and/or reception source (C, R), for the provision or reception of a beam in a selected direction, defined by a selected phase value and a selected amplitude value. At least one of the sources for transmission and/or reception (C, R) is coupled to a processor (MT) for deviation of the beam thereof and the direction of reception in at least one other direction, selected by variation of at least the amplitude value.

15 Claims, 5 Drawing Sheets

FIG.3
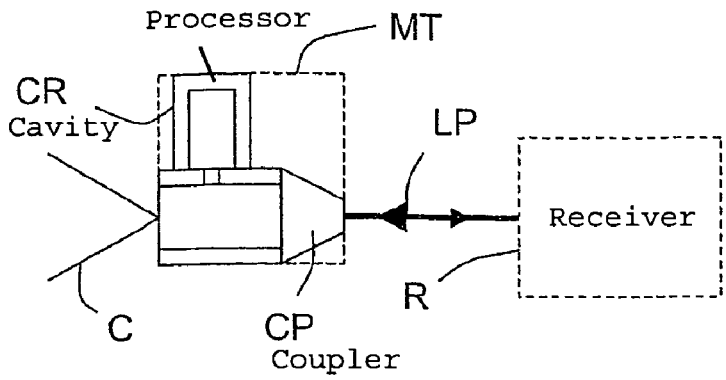
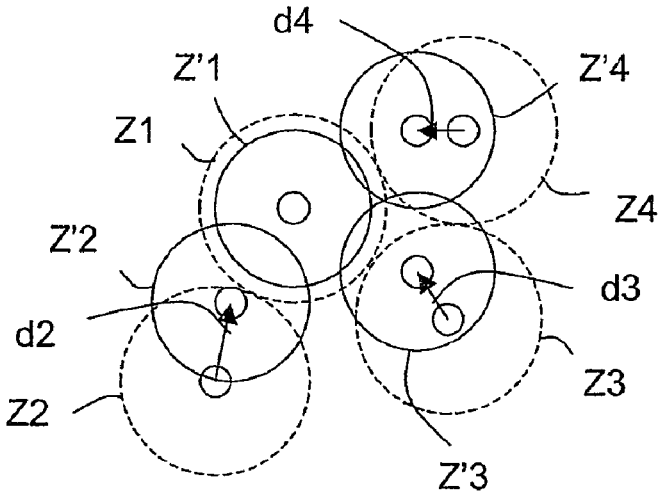
FIG.4
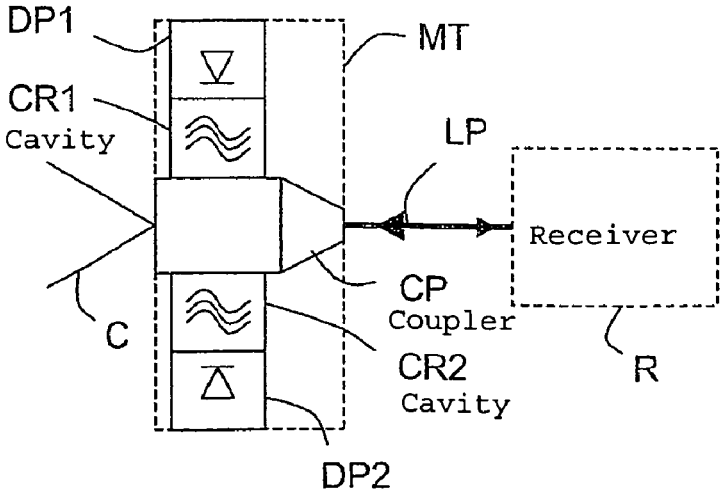
FIG.5

FIG.6
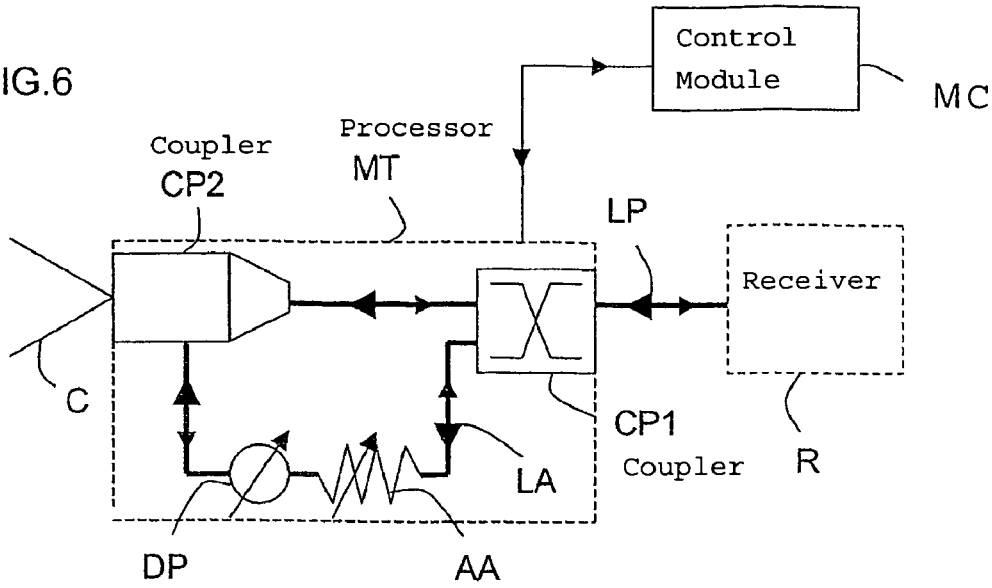
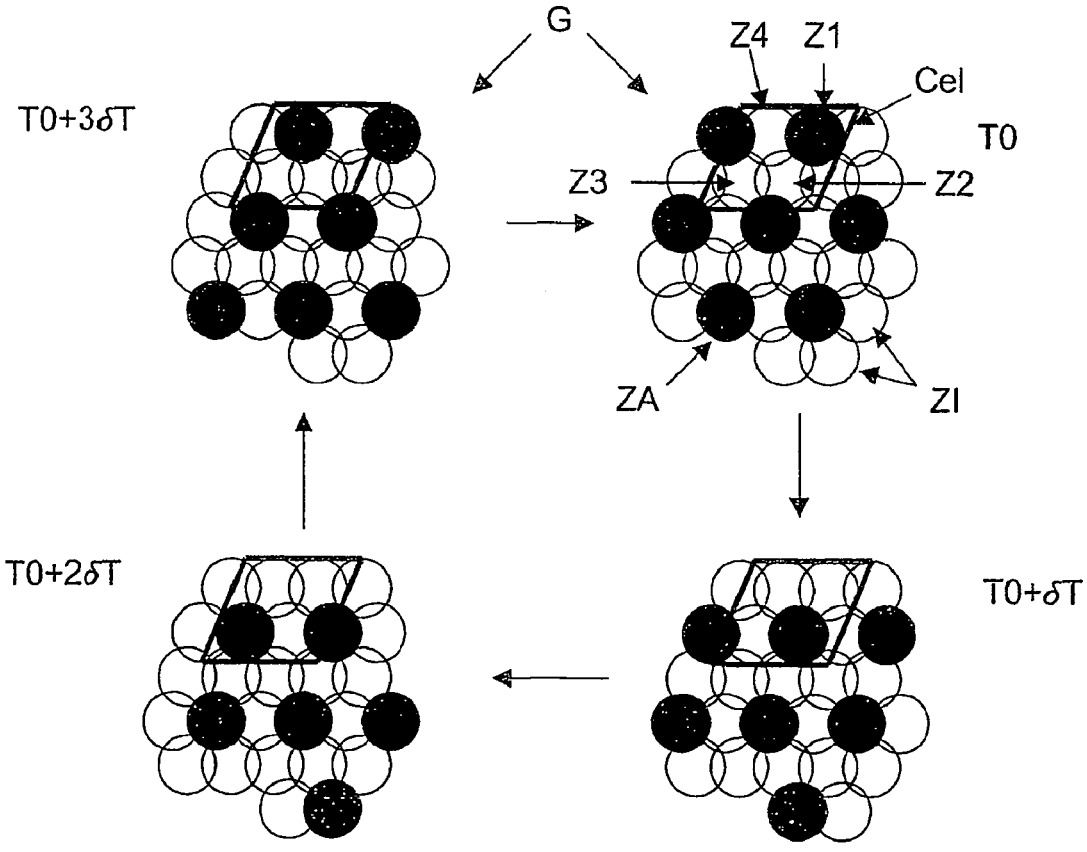
FIG.7

SATELLITE WITH MULTI-ZONE COVERAGE OBTAINED BY BEAM DEVIATION

BACKGROUND OF THE INVENTION

The field of the invention is that of satellite communications, and more particularly that of controlling the coverage of multiple geographical areas (also known as "spots") by communication satellites.

In the field of communications, in particular satellite communications, it is desirable for reception quality to be as good as possible. To this end, it is not only necessary that the reception area be covered, but also that the power of the received signals be sufficient.

Of the many types of multizone satellite coverage, there may in particular be cited that which the person skilled in the art knows as multibeam "beam hopping". Broadly speaking, this type of coverage consists in providing continuous multizone (send and/or receive) coverage with passive antennas, the zones being grouped into cells within each of which only one, so-called "active", zone is covered at any time and the various zones of the cells being active one after the other, periodically. In particular, this type of coverage enables the whole of the available frequency band to be allocated to an "active" portion of the set of zones during a given period.

Various arrangements provide this type of coverage. They are all based on the same technology whereby each coverage zone is associated with a sending source.

A first arrangement uses first, second, third and fourth send/receive (two-band) antennas containing sources respectively defining first, second, third and fourth zones, each cell then consisting of a first zone, a second zone, a third zone and a fourth zone. In this type of arrangement the mesh available at the level of the sources is sufficiently large to allow the use of wide-aperture (typically 4 to 6λ) sources that are therefore highly directional. This yields very high illumination efficiencies, typically from 75% to 80%. However, the antennas being two-band antennas, the edge of coverage gain ($G_{EOC}$) cannot be simultaneously optimized for sending and receiving. Moreover, beam hopping being effected by antenna switching, the losses generated at the level of the connecting guide between each source and the switch are high.

A second arrangement reproduces the preceding arrangement with the number of antennas doubled to four send antennas and four receive antennas. In this type of arrangement the mesh being substantially identical to that of the preceding arrangement it is therefore possible to obtain very high illumination efficiencies, typically from 75% to 80%. The antennas in this case being optimized in each frequency band, it is therefore possible to optimize the edge of coverage again ($G_{EOC}$) simultaneously for sending and for receiving. However, using eight antennas introduces significant layout constraints. Moreover, beam hopping also being effected by antenna switching, the losses generated at the level of the connecting guides between each source and the switch are high.

A third arrangement is based on the first arrangement and reduces the number of antennas to three. Here the available mesh is slightly smaller than in the above two arrangements, so that the sources have an aperture of the order to 3 to 5λ and are therefore slightly less directional. The illumination efficiency remains very acceptable and layout constraints are greatly reduced. However, beam hopping is still effected by antenna switching, so the losses generated at the level of the connecting guides between each source and the switch are high. Moreover, the mesh being tighter, the carrier/interference (C/I) ratio is degraded (the interfering signals "I" are generated by the other sources that are operating in the same frequency band and with the same polarization as the active zone).

A fourth arrangement consists in using only one send antenna and one receive antenna. Beam hopping now being effected by switching within the same antenna, the losses generated at the level of the connecting guides between each source and the switch are low. However, defining all the zones with a single antenna imposes a very tight mesh, so that the sources have an aperture of the order of 1.2 to 1.5λ and are therefore only very slightly directional. The illumination efficiency is then very low (typically from 35% to 40%), which imposes oversizing of the antenna reflectors and the antennas, which can lead to technology problems, especially if the satellite is operating in the "Ka" frequency band. The edge of coverage gain ($G_{EOC}$) is therefore reduced by 3 to 4 dB compared to the preceding arrangements, and the "roll-off" (the gain variation over the whole of the multizone coverage, and to be more precise the difference between the maximum gain in each zone and the EOC gain) is very high, typically of the order of 8 to 12 dB compared to the 4 to 6 dB of the preceding arrangements.

Thus no prior art arrangement gives entire satisfaction in terms of multizone coverage by "beam hopping".

The situation is substantially the same in respect of the other types of multizone coverage and in particular multizone coverage by static deviation of multiple beams and multizone coverage by dynamic deviation of one beam.

SUMMARY OF THE INVENTION

One object of the invention is therefore to improve the situation in respect of multizone coverage.

To this end it proposes a multizone coverage telecommunication satellite including at least one send and/or receive antenna comprising at least one sender and/or receiver adapted to send and/or receive a beam in a chosen direction defined by a chosen phase and a chosen amplitude.

This satellite is characterized in that at least one of the senders and/or receivers is coupled to processing means for deviating its beam or its receive direction in at least one other chosen direction by variation of at least the amplitude.

If multiple deviation is required, the processing means deviate the beam in a plurality of chosen directions as a function of a variation law in respect of the amplitude.

Using a small number of senders and/or receivers simplifies in particular the architecture of the antennas and the satellites that carry them, improves the directionality and the C/I ratio thereof and controls the roll-off thereof.

In an embodiment adapted to arrangements in which the sender and/or receiver comprises a main line connecting a feeder module to a send module and/or receive module, the processing means preferably comprise a first coupler installed on the main line and coupled to a first end of an auxiliary line comprising amplitude variation means and a second coupler installed on the main line between the first coupler and the send or receive module and connected to a second end of the auxiliary line. In this case, the second coupler may be a mode extractor coupler, for example a mode extractor comprising a circular waveguide coupled to at least one rectangular waveguide via a row of slots.

Alternatively, the processing means may comprise a single coupler installed on the main line and coupled to at least one resonant cavity defining the amplitude. In this case the processing means may comprise at least two resonant cavities each controlled by a PIN diode and having selected electromagnetic couplings between them that define the amplitude.

According to another feature of the invention, the processing means may deviate the beam or the receive direction in at least one of the chosen directions by varying the amplitude and the phase. If multiple deviation is required, the deviation is preferably a function of a law of variation of the amplitude and a law of variation of the phase. The embodiment with auxiliary line described above then comprises phase variation means installed on said auxiliary line. Similarly, in the embodiment with resonant cavities, the single coupler is coupled to at least three resonant cavities each controlled by a PIN diode and having chosen electromagnetic couplings between them defining the amplitude and the respective positions whereof relative to the coupler define the phase.

If this proves necessary, the send and/or receive antenna comprises a multiplicity of senders and/or receivers each sending or receiving a beam in a chosen direction and first control means intended to control the processing means (which are coupled to the senders and/or receivers) as a function of a chosen spatial-temporal scheme.

In this case, the processing means of each sender and/or receiver may deviate their beam (or their receive direction) cyclically in N (for example N=4) different directions corresponding to N coverage areas, each beam (or receive direction) being deviated in one of the N directions for a chosen duration equal to the $N^{th}$ part of the cycle duration. The first control means may then instruct the processing means to function simultaneously and in cycles of equal duration so that the satellite assures multizone coverage by beam hopping.

The invention finds a particularly beneficial application to sending and/or receiving beams in the "Ku" and/or "Ka" frequency band(s), although this application is not limiting on the invention.

BRIEF DESCRIPTION OF THE DRAWINGS

Other features and advantages of the invention will become apparent on reading the following detailed description and examining the appended drawings, in which:

FIG. 3 is a diagram of a first embodiment of a send and/or receive channel of a send and/or receive antenna of a satellite of the invention, FIG. 4 is a diagram of one example of multizone coverage adapted to static deviation of a beam, FIG. 5 is a diagram of a second embodiment of a send and/or receive channel of a send and/or receive antenna of a satellite of the invention, FIG. 6 is a diagram of a third embodiment of a send and/or receive channel of a send and/or receive antenna of a satellite of the invention, FIG. 7 is a diagram of one example of multizone coverage in the case of a beam hopping application.

The appended drawings constitute part of the description of the invention as well as contributing to the definition of the invention, if necessary.

DETAILED DESCRIPTION OF THE INVENTION

The invention relates to telecommunication satellites that provide multizone send and/or receive coverage, and in particular to satellites of this kind comprising at least one passive send antenna and/or at least one passive receive antenna.

An application of the invention to a send and/or receive antenna A of a satellite ST is described first with reference to FIGS. 1 to 5. The satellite ST is not shown in these figures to avoid overcomplicating the diagrams.

Figure 1:
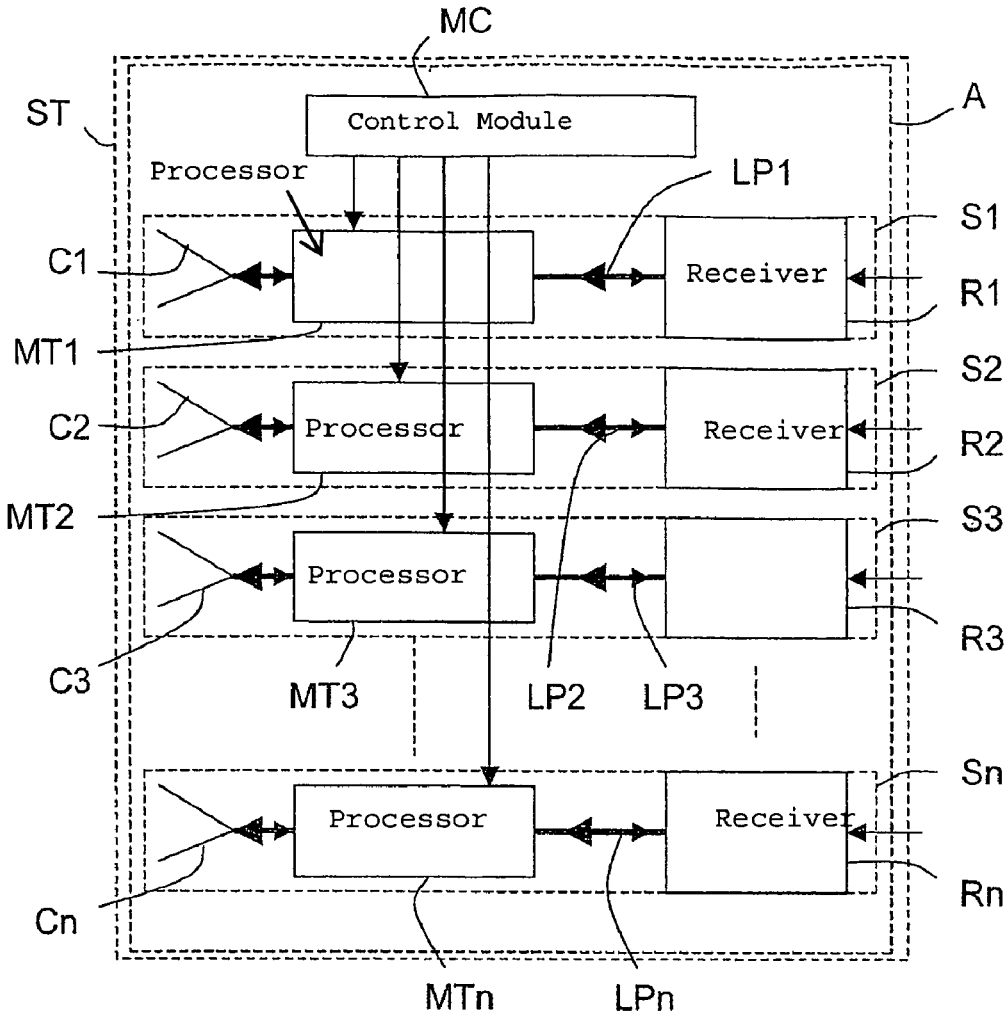
FIG. 1 is a functional block diagram of a multichannel send and/or receive antenna of a satellite of the invention.

As shown in FIG. 1, a satellite antenna of the invention comprises one or more send and/or receive channels i (here i=1 to n) each constituting a sender and/or receiver Si capable of sending a beam or receiving beams in at least two chosen directions, each defined by a chosen phase and a chosen amplitude. A sender and/or receiver S1-Sn of the above kind comprises a send and/or receive module R1-Rn, for example a transponder (such as a send high-power amplifier (HPA) or receive low-noise amplifier (LNA)), and a sender and/or receiver C1-Cn, for example a horn, coupled to the send and/or receive module R1-Rn by a main line LP1-LPn, for example a waveguide, equipped with a processing module MT1-MTn.

The function of the processing module MT1-MTn is to deviate the beam (or the receive direction) that the associated horn C1-Cn must send (and/or receive) in at least one chosen direction that differs from the direction associated with the standard propagation mode of the send and/or receive channel i (or source S1-Sn), which is defined by an amplitude A and a phase Φ.

Figure 2:
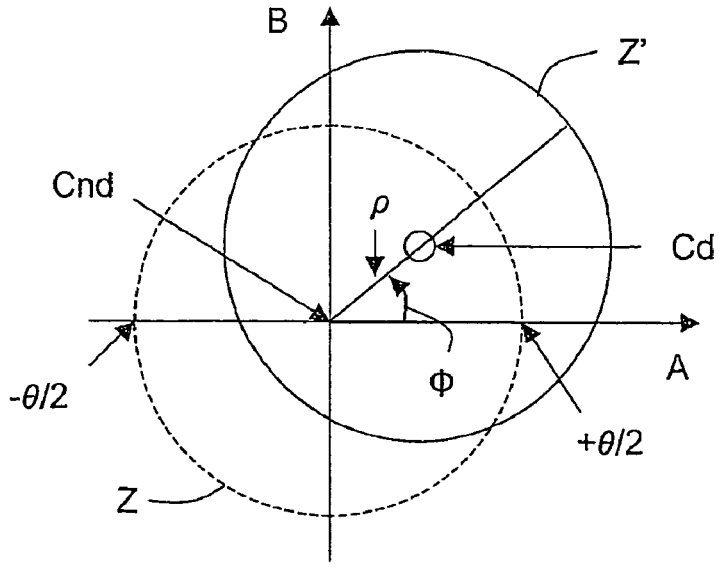
FIG. 2 is a diagram showing the mechanism of send beam deviation or receive direction deviation.

The deviation is obtained at least by a variation ρ of the value of the amplitude A of the beam sent or received by a send and/or receive module R. However, as shown on FIG. 2, the deviation may be obtained by a variation ρ of the value of the amplitude A and by a variation of the value of the phase Φ applied simultaneously. In FIG. 2, the dashed line circle Z with center Cnd shows the coverage of an area with a sent or received beam without processing (or deviation) by a horn C1-Cn of a send and/or receive antenna with an angular "dispersion" θ; the solid line circle Z' with center Cd shows the coverage of a zone by a deviated beam sent or received by the same horn C1-Cn with the same angular dispersion θ.

It is clear that by varying the amplitude and where applicable the phase of a send or receive beam it is possible to choose the plane in which said beam must be deviated.

The maximum deviation is limited to the value of θ, which corresponds to the 3 dB width of the lobe.

The processing module TMi may be adapted in various ways to provide this deviation.

For example, a first way consists in installing on the main line LP of a send and/or receive channel one or more resonant cavities adapted to vary the amplitude and where applicable the phase of the signals.

In the example shown in FIG. 3, the processing module TM comprises a coupler CP installed on the main line LP and coupled to a single resonant cavity CR. The electromagnetic coupling between the coupler CP and the cavity CR excites one or two modes of higher order than that of the telecommunication signal to be sent or the received telecommunication signal, coming from the send and/or receive module R, respectively, which induces a deviation of the main send and/or receive lobe of the horn C, and consequently of the send beam or the receive direction of the receive beam which contains said telecommunication signal.

This embodiment allowing only one deviation is particularly suitable for situations in which beam deviation is static.

This is the case, for example, when it is required to use large sources to generate overlapping zones (or spots); the sources are prepositioned since the respective positions of the spots to be generated are known in advance. In this case, the invention can replace one or more spots whilst additionally offering more directional sources, as shown in FIG. 4. To be more precise, in the FIG. 4 example, the dashed line circles Z1 to Z4 represent four adjacent sources and the solid line circles Z'1 to Z'4 show the final positions of the zones (or spots) covered by said sources after processing (the spots corresponding to the sources without processing are circles concentric with the dashed line circles Z1 to Z4 with diameters equivalent to those of the solid line circles Z'1 to Z'4 and the arrows represent the displacements d2 to d4 of the centers of the zones Z2 to Z4). This example corresponds in particular to satellites that use four 1.74° sources in the S band (2500 MHz). In this case, the invention can substitute a 5 m antenna equipped with four highly directional sources for either a 9 m antenna equipped with at least twelve sources and a beam forming network (BFN), which is a device for applying amplitude and phase laws to all the sources to generate four spots, in which case three or four sources are employed to generate each spot and certain sources may be used more than once, or three 5 m antennas equipped with four sources. The result of this is improved gain, optimized roll-off and a significantly reduced overall size.

This embodiment also corresponds to situations requiring the coverage of overlapping adjacent zones. This kind of situation corresponds in particular to satellites using four antennas, one of which provides coverage by means of Ku and Ka spots.

Satellites of the above kind generally cover nine zones in the Ka band and four zones in the Ku band. The Ku receive band corresponds substantially to the range (13.7 GHz, 15.6 GHz) and the Ku send band corresponds substantially to the range (10.7 GHz, 12.8 GHz). The Ka receive band corresponds substantially to the range (27.5 GHz, 30 GHz) and the Ka send band corresponds substantially to the range (18.2 GHz, 20.2 GHz). In this case, the invention allows the use of highly directional Ka and Ku sources, and consequently significantly improves the gain and the C/I ratio, optimizes roll-off and significantly reduces power consumption.

This embodiment also corresponds to situations requiring dynamic deviation of a beam (also known as "theater displacement"). This situation may arise if a beam is used having an angular dispersion from about 1.6° to about 3.2°, providing coverage of a zone of 1000 to 2000 kilometers. This is the case during certain events in particular, such as the Olympic Games. Here the invention enables a beam to be repositioned at will, electronically and quickly, without having to move the satellite, as is the case at present, and this reduces energy consumption and significantly improves the accuracy and speed of positioning.

A variant of this embodiment using a single resonant cavity active at all times consists, as shown in FIG. 5, in using on each send and/or receive channel i (or source S1-Sn) a processing module MT comprising a coupler CP installed on the main line LP and coupled to at least two resonant cavities CR1, CR2 each controlled by a PIN diode DP1, DP2 and electromagnetically coupled in a manner chosen to vary the amplitude and where applicable the phase. The electromagnetic coupling via the coupler CP between the cavities CR1 and CR2 allows excitation of one or two modes of higher order than the fundamental mode of the telecommunication signal to be sent, coming from the send and/or receive module R, which induces a deviation of the main sending lobe of the horn C, and consequently of the send beam or the receive direction. To be more precise, the amplitude ρ of the deviation is fixed by the coupling between the resonant cavities and the variation of the value of the phase Φ is fixed by the position of the resonant cavities.

Here the number of deviations is set by the number of combinations of activation of the various resonant cavities CR via the associated control PIN diodes DP, which obviously depends on the number of resonant cavities used (for example four or eight cavities). FIG. 6 shows a second way of implementing the processing module MT. This consists in installing on the main line LP of a send and/or receive channel (or source S) a first coupler CP1, which is coupled to a first end of an auxiliary line LA comprising an amplitude attenuator AA and a phase shifter DP, and a second coupler CP2 (on the downstream side of the first coupler CP1), which is coupled to a second end of the auxiliary line LA.

In this embodiment, and in the nonlimiting case of sending a telecommunication signal, the first coupler CP1 is adapted to sample from the main line LP a portion of the telecommunication signal to be sent in beam form, so as to inject it into the auxiliary line LA, where it is subjected to amplitude variation in the amplitude attenuator AA and where applicable to phase variation in the phase shifter DP, before being reinjected into the main line LP by the second coupler CP2.

The second coupler CP2 generates at the input of the horn C one or two modes (for example the modes TM0 and TE21 that generate antisymmetrical radiation diagrams with no signal on the axis) of higher order than the fundamental mode of the telecommunication signal to be sent, as coming from the send module R, which induces the deviation of the beam. In other words, injecting one or two higher order modes at the input of the horn C leads to deviation of its main send lobe. By virtue of the theorem of reciprocity, which applies when the elements are passive, this applies equally to reception.

The amplitude attenuator M and/or the phase shifter DP may be of the variable type if necessary.

For example, a beam may be deviated in four directions by varying the amplitude by a fixed amount in the attenuator AA and varying the phase in steps ΔΦ of 90° in the phase shifter DP. As a general rule, a beam can be deviated in N directions by varying the amplitude by a fixed amount and varying the phase by steps ΔΦ of 360°/N. In these situations, the processing module TM is therefore configured to vary the amplitude in accordance with a chosen amplitude law and/or the phase in accordance with a chosen phase law.

Of course, an embodiment may be envisaged in which the phase shift DP is omitted. In this case, the deviation results exclusively from an amplitude variation.

Figure 8:
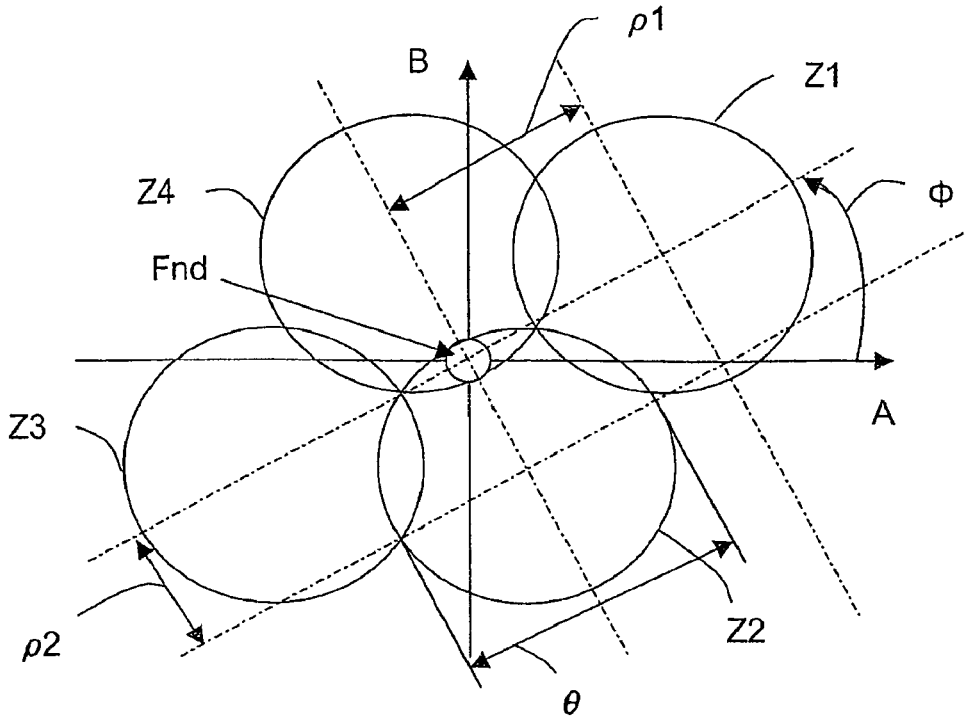
FIG. 8 is a diagram of the beam deviation (or switching) mechanism implemented in a cell in a beam hopping application.

This embodiment, just like that described above with reference to FIG. 5, is particularly well suited, although not exclusively so, to multizone coverage by beam hopping, as shown in FIGS. 7 and 8.

As indicated in the introduction, multizone (or multispot) coverage by beam hopping consists in forming a "cluster" or "mosaic" G of adjacent coverage zones (or spots) Z which preferably overlap partially.

Each cluster G is divided into cells Cel including the same number j of zones Zj. In the example shown in FIGS. 7 and 8, each cell Cel consists, for illustrative purposes, of four zones Zj (j=1 to 4). Beam hopping consists in activating only one zone Zj of each cell Cel of a cluster G at a time. Consequently, the zones Zj of the some cell Cel are active (or covered) one after the other, periodically and preferably for identical durations equal to the jth portion δT of the period, under the control of the control module MC. In FIG. 7, the active zones ZA of a cluster G are shown in black and the inactive zones ZI are shown in white.

Accordingly, the whole of the available frequency band can be allocated to an (active) portion of the set of zones during a given period. This situation corresponds, in particular, to satellites that define at any given time around 100 active zones ZA in the Ka band with an angular dispersion (or extent) of about 0.36°.

Thanks to the invention, the same source S1-Sn can now cover the four (or N) zones Zj of the same cell Cel using the beam deviation principle described above.

For example, in the situation shown in FIG. 8, the horn C1-Cn of the sender or receiver S1-Sn (or the send and/or receive channel i) is adapted to put out an unprocessed (or non-deviated) beam whose center is indicated by the small black circle Fnd and the processing module MT1-MTn associated with this source S1-Sn is adapted to deviate the beam in four different directions which (here) define the four zones Z1 to Z4 of a cell Cel.

In this example, the first zone (or spot) Z1 corresponds to a beam deviated in a first direction defined by an amplitude A0 and a phase Φ0, the second zone Z2 corresponds to a beam deviated in a second direction defined by an amplitude A0/3 and a phase Φ0+90°, the third zone Z3 corresponds to a beam deviated in a third direction defined by an amplitude A0 and a phase Φ0+180°, and the fourth zone Z4 corresponds to a beam deviated in a fourth direction defined by an amplitude A0/$\sqrt{3}$ and a phase Φ0+270°. Moreover, if the angle θ subtended by the beam sent (or received) by the horn C is made similar to the diameter of a zone Zj, then the amplitude of deviation ρ1 of the center of the beam corresponding to the first zone Z1 relative to the reference direction defined by the center of the undeviated beam Fnd is substantially equal to 3θ/4 and the deviation amplitude ρ2 of the center of the beam corresponding to the second zone Z2 relative to the reference direction is substantially equal to θ$\sqrt{3}$/4.

The processing module MT1-MTn of a send and/or receive channel i (or source S1-Sn) is therefore adapted to "switch" the beam sent by (or the receive direction of the beam received by) its horn C1-Cn from one zone to another. In the case of sending, for example, during the first quarter of the period the beam is deviated in the first direction, so that only the first zone Z1 of the cell C1-Cn is covered (or active). This situation corresponds to the upper right-hand portion of FIG. 7 (T0). During the second quarter of the period the beam is deviated in the second direction, so that only the second zone Z2 of the cell C1-Cn is covered (or active). This situation corresponds to the lower right-hand portion of FIG. 7 (T0+δT). During the third quarter of the period the beam is deviated in the third direction, so that only the third zone Z3 of the cell C1-Cn is covered (or active). This situation corresponds to the lower left-hand portion of FIG. 7 (T0+δT). Finally, during the fourth quarter of the period the beam is deviated in the fourth direction, so that only the fourth zone Z4 of the cell C1-Cn is covered (or active). This situation corresponds to the upper left-hand portion of FIG. 7 (T0+3δT). Once the period has elapsed, the cycle resumes at the level of the first zone Z1 and so on.

The control module MC of the send antenna A causes the processing modules MTi of each send channel i (or source S1-Sn) to operate in accordance with a spatial-temporal law. The control module MC preferably controls the processing modules MTi so that they function synchronously, simultaneously and periodically and so that during each period fraction δT the same zone Zj of each cell Cel is activated (or covered).

The invention therefore enables the use of j times fewer Ka sources than the prior art (j=2, 3, 4, . . . ), which significantly reduces the overall size of the satellite (for example there is only one send antenna instead of four). Moreover, these sources can be highly directional, optimizing illumination efficiency. Also, this optimizes the edge of coverage gain $G_{EOC}$. Finally, the beam hopping type switching being effected within the same antenna, waveguide losses are greatly reduced.

By virtue of the theorem of reciprocity, which applies if the elements are passive, this also applies to reception.

One embodiment of a second coupler CP2 that can be used on a send and/or receive channel of the type of cells shown in FIGS. 1 and 6 is described next with reference to FIGS. 9A to 9C.

In this embodiment, the second coupler CP2 is preferably a "mode extractor" coupler adapted to sample from the main line LP, at the output of the receive horn C, the tracked mode(s) to inject it (or them) into the first auxiliary line LA. The mode extractor coupler CP2 is designed to define a short circuit plane for the tracking mode(s) that will constrain it (or them) to rejoin the first auxiliary line LA (the lower order standard (or fundamental) propagation mode, as well as the other non-tracked modes therefore continuing along their path within the main line LP).

For example, the mode extractor coupler CP2 is adapted to extract and/or to generate the TMO1 and TE21 modes from the main line LP and inject them into the first auxiliary line LA.

This extraction and/or generation of mode(s) may be effected in various ways. However, it is advantageous to use for this purpose one or more rows of coupling slots, as shown in FIGS. 9A to 9C.

The send and/or receive element is here of the monoblock type. It comprises an upstream portion defining a horn C and a downstream portion extending the upstream portion and defining a mode extractor coupler CP2. In fact, the downstream portion CP2 here consists of: i) a central waveguide LP of circular section defining the main line in which are extracted and/or generated the tracked modes, ii) four peripheral waveguides LAa to LAd of rectangular section defining four portions of the first auxiliary line, and iii) four rows of coupling slots FEa to FEd, preferably of rectangular shape, providing the coupling between the central waveguide LP and the four peripheral waveguides LAa to LAd.

Of course, other types of coupling slots may be used, for example slots of circular, elliptical or cruciform shape, etc.

In this embodiment, the tracked higher order modes are therefore extracted and/or generated from the main waveguide LP by the coupling slots FEa to FEd and then injected into peripheral waveguides LAa to LAd.

Figure 9A:
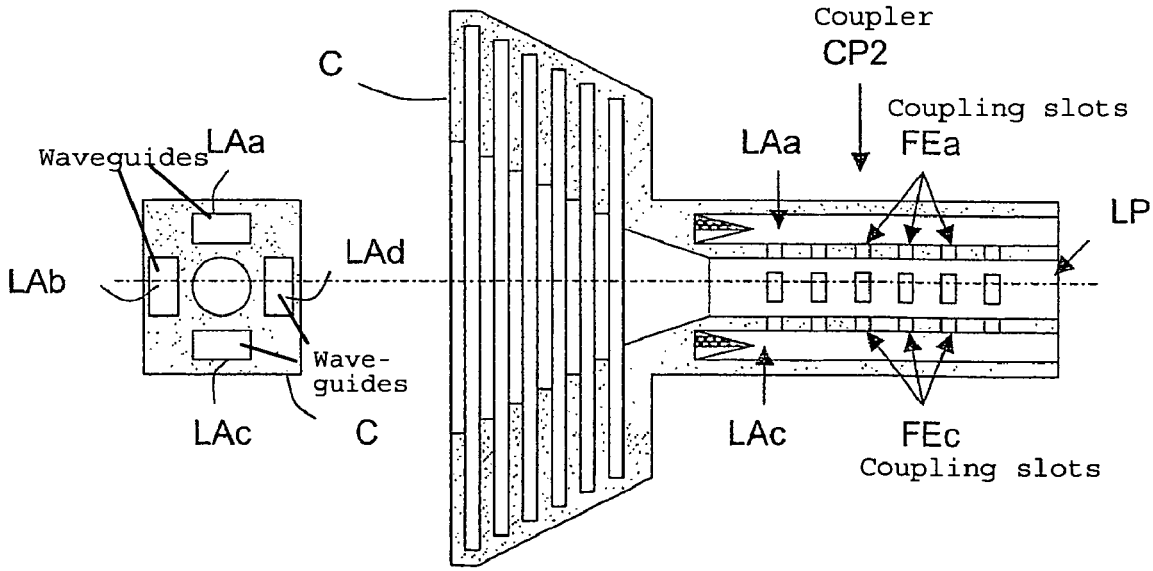
FIGS. 9A to 9C are views, respectively in longitudinal section, partial perspective (CP2) and transverse section at the level of CP2 of one embodiment of a mode extractor coupler used in a send and/or receive channel of a send and/or receive antenna of the type shown in FIG. 6.
Figure 9B:
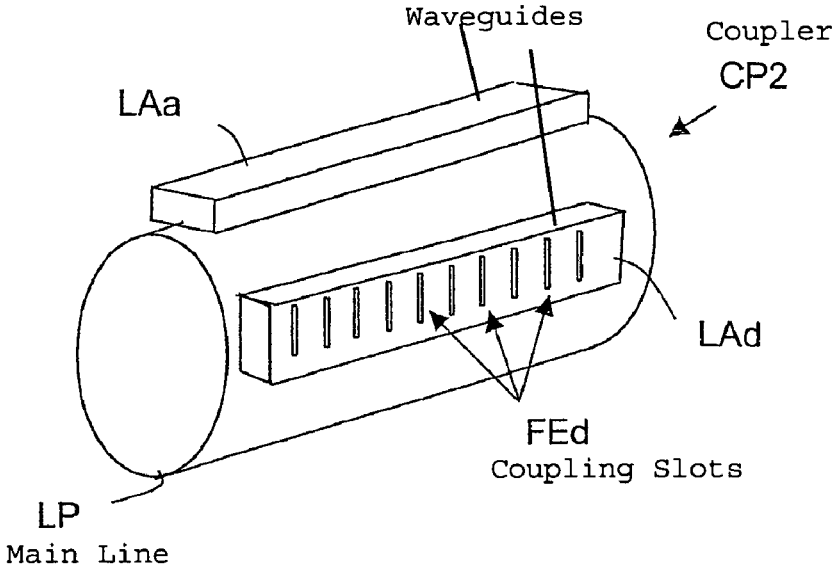
Figure 9C:
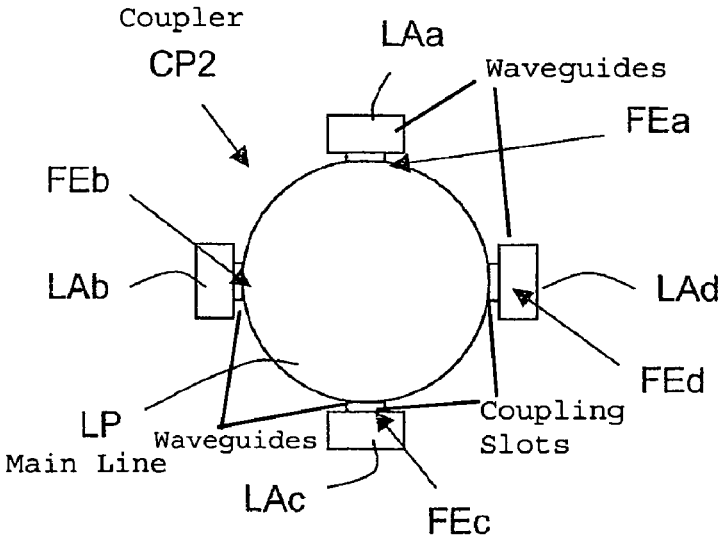

Of course, the number of rows of slots, and consequently the number of peripheral waveguides, of the embodiment shown in FIGS. 9A to 9C is not limited to four. This number can take any value greater than or equal to one (1). It is important to note that the number of rows does not correspond to the number of modes extracted and/or generated. Indeed four rows of slots may be used to extract and/or generate a single higher mode. Moreover, the number of rows is also used to distribute the extraction and/or generation of the higher modes without interfering with the main telecommunication channel. This is why rows of coupling slots with circular symmetry are generally used, for example four rows at 90°, eight rows at 45°, etc. Furthermore, coupling via slots has been described, but coupling by means of probes may equally be envisaged if the first auxiliary line is coaxial.

Generally speaking, it is preferable to extract at most two higher order modes.

Only one higher order mode (generally the TMO1 mode) is used if the polarization of the incident or transmitted wave is circular. Knowing the values of the amplitude and the phase, a single mode then suffices each time for determining the parameters ρ and Φ described above with reference to FIG. 2. In other words, in the case of circular polarization, and using only one mode, it is possible to deviate the send beam (or the receive direction) in any direction in space within the limits of the width of the main lobe at the 3 dB points ($\theta_{3\ dB}$).

On the other hand, two higher order modes (generally the orthogonal pairs (TMO1 and TE21) or (TE21 and TE21)) are used if the polarization of the incident or transmitted wave is linear. Knowing the values of the amplitude and the phase of these two modes, it is possible each time to determine the parameters ρ and Φ described above with reference to FIG. 2. In other words, in the case of linear polarization, using two orthogonal modes, the send beam (or the receive direction) can be deviated in any direction in space within the limits of the width of the main lobe at the 3 dB points ($\theta_{3\ dB}$).

It is equally important to note that, in this latter embodiment, the coupling cannot be modified dynamically because a mode extractor is a mechanical part that has to be carved out. Consequently, once the polarization of the wave has been chosen, it remains only to determine whether one or two higher order modes will be extracted, and then to design the mode extractor accordingly.

The invention is not limited to the telecommunication satellite embodiments described hereinabove by way of example only, and encompasses all variants that the person skilled in the art might envisage that fall within the scope of the following claims.

The invention claimed is:

1. A multizone coverage telecommunication satellite including at least one send and/or receive antenna comprising at least one sender and/or receiver channel adapted to send and/or receive a beam in a chosen direction defined by a chosen phase and a chosen amplitude, wherein at least one of the sender and/or receiver channels includes a processor for deviating its beam or its receive direction in at least one other chosen direction by variation of at least said amplitude, wherein said sender and/or receiver channel comprises a main line connecting a feeder module to a sender and/or receiver, and said processing means comprise a first coupler installed on said main line and coupled to a first end of an auxiliary line comprising amplitude variation means and a second coupler installed on said main line between said first coupler and said sender and/or receiver and connected to a second end of said auxiliary line.

2. A satellite according to claim 1, wherein said second coupler is a mode extractor coupler.

3. A satellite according to claim 2, wherein said mode extractor coupler is a mode extractor.

4. A satellite according to claim 3, wherein said mode extractor comprises a circular waveguide coupled to at least one rectangular waveguide via a row of slots.

5. A satellite according to claim 4, wherein said slots have a shape selected from a group including at least rectangles, ellipses and crosses.

6. A satellite according to claim 1, wherein said auxiliary line comprises phase variation means.

7. A multizone coverage telecommunication satellite including at least one send and/or receive antenna comprising at least one sender and/or receiver channel adapted to send and/or receive a beam in a chosen direction defined by a chosen phase and a chosen amplitude, wherein at least one of the sender and/or receiver channels includes a processor for deviating its beam or its receive direction in at least one other chosen direction by variation of at least said amplitude, wherein, said send and/or receive channel comprises a main line connecting a feeder module to a sender and/or receiver, and said processing means comprise a coupler installed on said main line and coupled to at least one resonant cavity defining said amplitude.

8. A satellite according to claim 7, wherein said processing means deviate said beam or said receive direction in a plurality of chosen other directions as a function of a variation law in respect of said amplitude.

9. A satellite according to claim 7, wherein said processing means comprise at least two resonant cavities each controlled by a PIN diode and having chosen electromagnetic couplings between them defining said amplitude.

10. A satellite according to claim 7, wherein said processing means deviate said beam or said receive direction in at least one of said other chosen directions by varying said amplitude and said phase.

11. A satellite according to claim 10, wherein said processing means deviate said beam or said receive direction in said chosen other directions as a function of a law of variation of said amplitude and a law of variation of said phase.

12. A satellite according to claim 7, wherein said processing means deviate said beam or said receive direction in said chosen other directions as a function of a law of variation of said amplitude and a law of variation of said phase, and further wherein said coupler is coupled to at least three resonant cavities each controlled by a PIN diode and having chosen electromagnetic couplings between them defining said amplitude and the respective positions whereof relative to said coupler define said phase.

13. A multizone coverage telecommunication satellite including at least one send and/or receive antenna comprising at least one sender and/or receiver channel adapted to send and/or receive a beam in a chosen direction defined by a chosen phase and a chosen amplitude, wherein at least one of the sender and/or receiver channels includes a processor for deviating its beam or its receive direction in at least one other chosen direction by variation of at least said amplitude, wherein said send and/or receive antenna comprises a multiplicity of senders and/or receivers each adapted to send and/or to receive a beam in a chosen direction and first control means adapted to control the first processing means coupled to said send and/or receive channels as a function of a chosen spatial-temporal scheme.

14. A satellite according to claim 13, wherein said processing means of each send and/or receive channel deviate a beam or said receive direction cyclically in N different directions corresponding to N coverage areas, each beam being deviated in one of said N directions for a chosen duration equal to the $N^{th}$ part of the cycle duration.

15. A satellite according to claim 14, wherein said first control means instruct said processing means to function simultaneously and in cycles of equal duration to assure multizone coverage by beam hopping.

* * * * *